US009617052B2

(12) United States Patent
McIntire et al.

(10) Patent No.: US 9,617,052 B2
(45) Date of Patent: Apr. 11, 2017

(54) PACKAGE WITH BLISTER CARD

(71) Applicant: MeadWestvaco Corporation, Richmond, VA (US)

(72) Inventors: Angela J. McIntire, Ringgold, GA (US); Alyssa Smith, Quinton, VA (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 14/758,939

(22) PCT Filed: Dec. 18, 2013

(86) PCT No.: PCT/US2013/076183
§ 371 (c)(1),
(2) Date: Jul. 1, 2015

(87) PCT Pub. No.: WO2014/107310
PCT Pub. Date: Jul. 10, 2014

(65) Prior Publication Data

US 2015/0336728 A1 Nov. 26, 2015

Related U.S. Application Data

(60) Provisional application No. 61/749,278, filed on Jan. 5, 2013.

(51) Int. Cl.

| | |
|---|---|
| ***B65D 75/36*** | (2006.01) |
| ***B65D 75/52*** | (2006.01) |
| ***B65D 73/00*** | (2006.01) |

(52) U.S. Cl.
CPC ..... *B65D 75/366* (2013.01); *B65D 73/0092* (2013.01); *B65D 75/522* (2013.01)

(58) Field of Classification Search
CPC . B65D 75/366; B65D 75/522; B65D 73/0092
USPC ..... 206/462, 461, 463, 471
See application file for complete search history.

(56) References Cited

U.S. PATENT DOCUMENTS

| | | | | |
|---|---|---|---|---|
| 3,756,384 | A | 9/1973 | Stone | |
| 6,170,663 | B1 * | 1/2001 | Glassman | B65D 75/32 206/461 |
| 6,230,964 | B1 * | 5/2001 | Saito | B65D 75/22 206/462 |
| 7,144,635 | B2 | 12/2006 | Hawes et al. | |
| 8,146,745 | B2 * | 4/2012 | Burress | B65D 75/368 206/462 |
| 2003/0159963 | A1 * | 8/2003 | Merk | B65D 5/008 206/470 |

(Continued)

FOREIGN PATENT DOCUMENTS

| | | |
|---|---|---|
| WO | WO2012112538 A1 | 8/2012 |
| WO | WO2012174186 A1 | 12/2012 |

OTHER PUBLICATIONS

International Preliminary Report on Patentability for PCT/US2013/076183, dated Jul. 16, 2015.

(Continued)

*Primary Examiner* — Steven A. Reynolds
(74) *Attorney, Agent, or Firm* — WestRock Intellectual Property Group

(57) ABSTRACT

A package is disclosed for housing a trap-sealed blister card within an outer housing with an optional window (142) for viewing a product (P) in the blister (300).

11 Claims, 4 Drawing Sheets

(56) References Cited

U.S. PATENT DOCUMENTS

| | | | | |
|---|---|---|---|---|
| 2006/0113215 | A1* | 6/2006 | Clements | B65D 5/18 206/779 |
| 2007/0125678 | A1* | 6/2007 | Green | B65D 73/0057 206/461 |
| 2008/0283435 | A1* | 11/2008 | Morgan | B65D 73/0092 206/484 |
| 2008/0314791 | A1* | 12/2008 | Schweitzer | B65D 73/0092 206/703 |
| 2009/0038977 | A1* | 2/2009 | Tilton | B65D 73/0057 206/469 |
| 2009/0139896 | A1 | 6/2009 | Bacon | |
| 2009/0159479 | A1 | 6/2009 | Smith et al. | |
| 2011/0139661 | A1* | 6/2011 | Ludwig | B29C 65/18 206/462 |
| 2011/0240503 | A1* | 10/2011 | Bailey | B65D 73/0092 206/469 |
| 2012/0012491 | A1 | 1/2012 | Wade | |
| 2014/0091003 | A1* | 4/2014 | Bradfield | B65D 73/0092 206/471 |
| 2014/0103100 | A1* | 4/2014 | Falcon | B65D 5/4204 229/103.2 |
| 2014/0353198 | A1* | 12/2014 | Bradfield | B65D 73/0014 206/470 |

OTHER PUBLICATIONS

International Preliminary Report on Patentability for PCT/US2013/076371, dated Jul. 16, 2015.

International Search Report for PCT/US2013/076183, dated Mar. 21, 2014.

International Search Report for PCT/US2013/076371, dated Mar. 25, 2014.

* cited by examiner

PACKAGE WITH BLISTER CARD

REFERENCE TO RELATED APPLICATION

This application is a National Phase entry into the United States of International Application PCT/US13/76183 filed on Dec. 18, 2013, which claims the benefit of priority under 35 U.S.C. §119(e) of U.S. provisional application Ser. No. 61/749,278 filed on Jan. 5, 2013, both of which are hereby incorporated by reference in their respective entireties.

BACKGROUND

This disclosure is directed to blister card packages and, more particularly, to blister packages having a trap-sealed blister card housed within a surrounding enclosure with an optional window for viewing a product in the blister. Much of the package may be formed from a single blank of paperboard.

Manufacturers and retailers of consumer goods, such as pharmaceuticals, software, electronics, health and beauty products and the like, typically package their products in various types of display packages. For example, many consumer goods are packaged in blister or clamshell packages formed by positioning a consumer good in a flanged blister made from various polymeric and/or paperboard materials and sealing the flanged blister between two paperboard substrates. Packages may be made based largely on paperboard, for example, NATRALOCK packages made by MeadWestvaco Corporation. Packaging made primarily of paperboard is more sustainable than packaging made from petroleum-based plastics. The paperboard used in such packages may be tear-resistant as described in commonly assigned U.S. Pat. No. 7,144,635.

Packages are often made by positioning a blister upon a display card (where the blister is entirely visible) or within a carton where at least a portion of the blister is visible. It is desired to have a package that contains the blister within an enclosure made from a single blank of sheet material.

SUMMARY

In one aspect a package is disclosed which includes a card having a front and a back surface, the card having an aperture therein; a blister having a body portion and a peripheral flange, the body portion protruding forward through the aperture, the peripheral flange in facing contact with the back surface of the card. The housing comprises a back panel having a top edge and an opposing bottom edge, a front panel having a top edge and an opposing bottom edge; the front panel having a window therein; and a bottom panel between the bottom edges of the back panel and front panel. The card is attached to the back panel with the flange between the card and the back panel, the top edges of the back panel and front panel are attached together; and the blister body extends forward toward or through the window.

Other aspects of the disclosed package will become apparent from the following description and the accompanying drawings.

DETAILED DESCRIPTION

Figure 1:
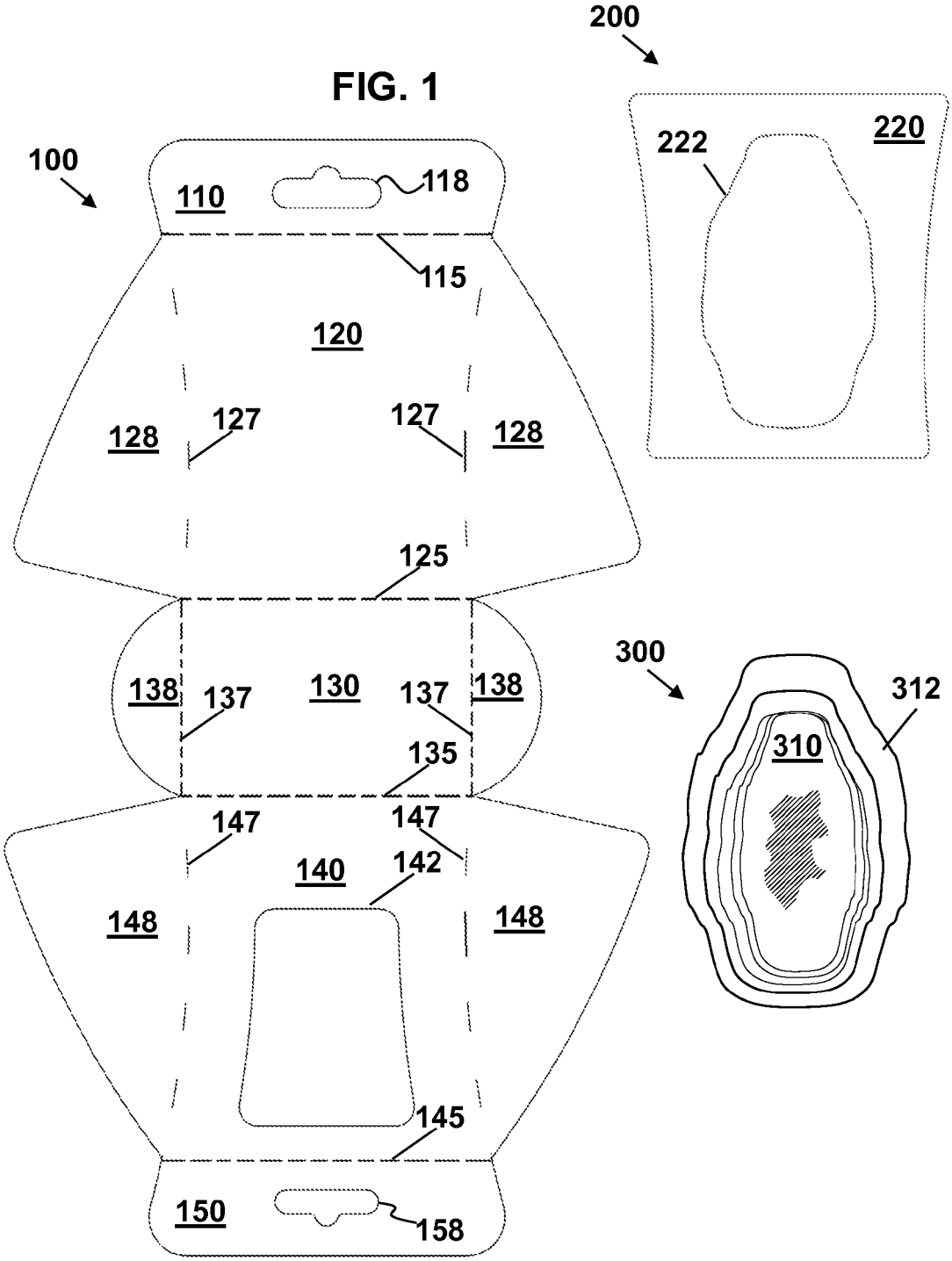
FIG. 1 is a plan view of a parts to form a package, the parts including an outer housing, inner card, and blister.

As various embodiments of the package are described, reference will be made to FIGS. 1-5. Certain parts of the packages are denoted by reference numerals. Where there is more than one of the same feature, only one may be denoted by a reference numeral. Typically in these Figures, where a plan view is shown for a blank of material, solid lines usually indicate periphery or cuts, and dashed lines usually indicate crease, score, or fold lines. In perspective views, solid lines typically show edges or folds, while dashed lines typically show hidden or partially obscured features. Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. The packages described here may be made from one blank (that is, the cut sheet parts from which the package components are made by folding and other steps) or from more than one blank. The word "card" or "panel" will often be used to describe a piece of sheet material such as paperboard, particularly with respect to a blank from which the package is made. Since panels are sometimes superimposed, for example, creating a two-layer or multi-layer structure, like features or panels will sometime coincide, in which cases, descriptions may call out the number identifying the feature closer to the viewer, that is, the feature visible in a particular Figure.

FIGS. 1-5 show a package having an outer housing containing an inner card and holding a blister within.

FIG. 1 shows a plan view of a housing blank 100, and inner card 200, and a blister 300 for forming the package. The view of the housing blank 100 as shown may be considered to represent an interior surface of the housing blank. Although advantageously formed from a single blank 100, the housing blank may instead comprise more than one piece of material.

Housing blank 100 may include a back top flap 110, a back panel 120, a bottom panel 130, a front panel 140, and a front top flap 150, which may be connected in series through crease, score or fold lines 115, 125, 135, 145, which may be generally straight. Thus it may be seen that the top flaps 110, 150 extend from upper edges of the back panel 120 and front panel 140 respectively. It may also be seen that the bottom panel 130 extends between the bottom edges of the back panel 120 and front panel 140.

Back side flaps 128 may be attached to back panel 120 along fold lines 127 which may be slightly curved or straight. Back side flaps 128 may be generally triangular as shown, or may have other shapes.

Bottom side panels 138 may be attached to bottom panel 130 along fold lines 137 which may be generally straight. Bottom side panels 138 may be generally semi-circular as shown, or may have other shapes.

Front side flaps 148 may be attached to front panel 140 along fold lines 147 which may be slightly curved or straight. Front side flaps 148 may be generally triangular as shown, or may have other shapes. Front side flaps 148 may have at least approximately the same shape and size as back side flaps 128. A window 142 may be formed in front panel 140.

A hang hole 118 may be formed in back top flap 110. A hang hole 158 likewise may be formed in front top flap 150. Back top flap 110 may have generally the same size and shape as front top flap 150. The hang holes 118, 158 may be superimposed in the finished package.

An inner card 200 may be provided as a sheet of material 220 sized and shaped to match or fit within the perimeter of back panel 120 and/or front panel 140. An aperture 222 may be provided in the inner card 200 to receive blister 300. The blister 300 may comprise a blister body 310 and a blister flange 312. The blister body 310 may fit through the aperture 222. The blister flange 312 may be larger than the aperture 222.

Figure 2:
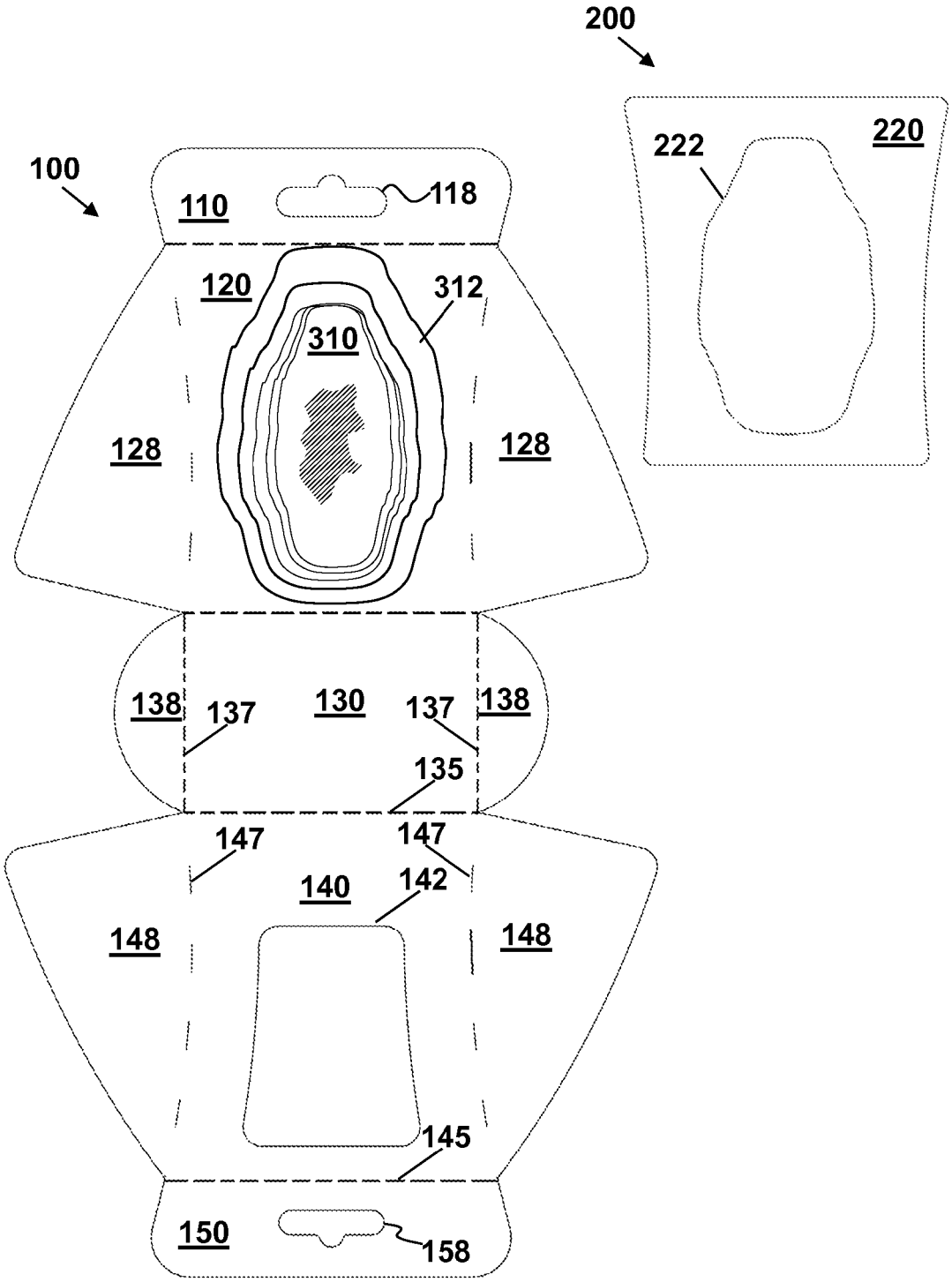
FIG. 2 is a plan view of the blister positioned onto an inner surface of the outer housing.
Figure 3:
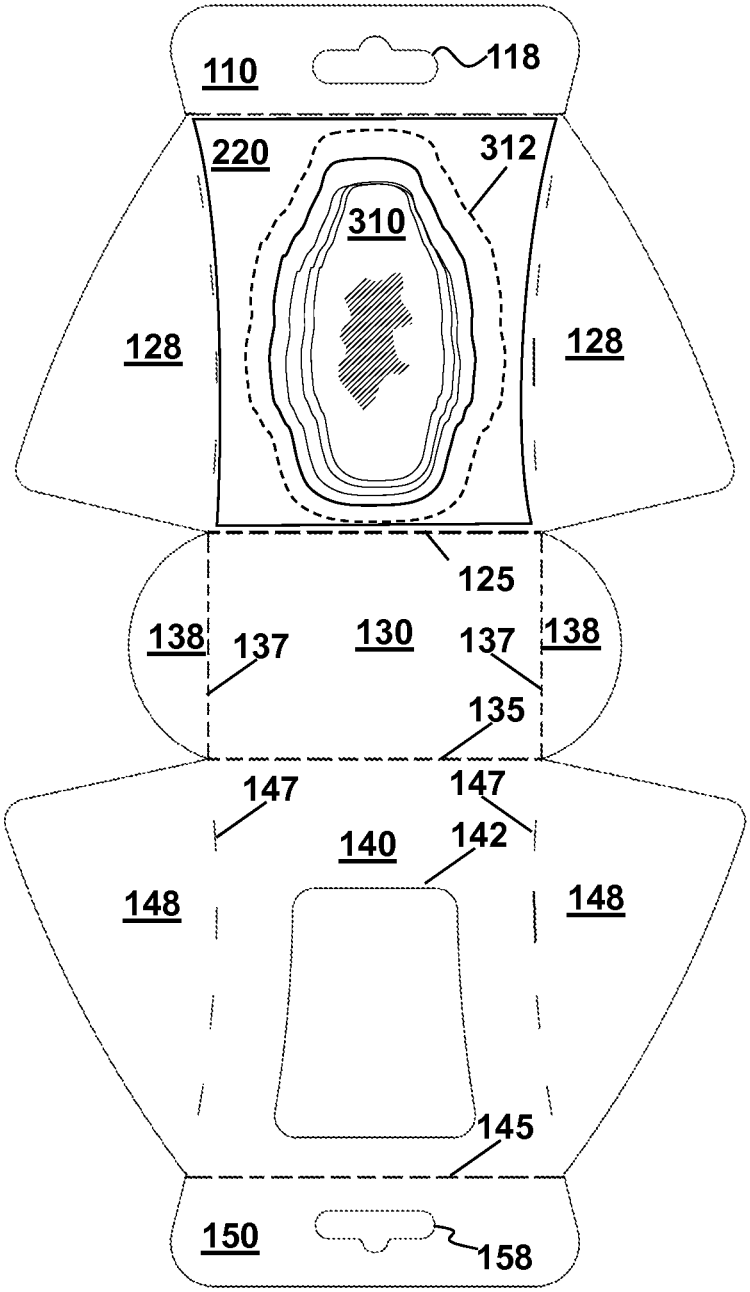
FIG. 3 is a plan view of the inner card placed upon the blister

As a step in the assembly of the package, blister 300 may be positioned upon the inner surface of back panel 120, as is shown in FIG. 2. A product item or items may first be placed into the blister. Then blister flange 312 may be attached to back panel 120, for example by adhesive, staples, or other method. However, it may be desirable to trap-seal the blister 300 into the package, by placing inner card 200 over the blister 300 as shown in FIG. 3. The inner card 200 and back panel 120 may then be sealed together with the blister body 310 protruding through aperture 222 and the blister flange 312 trap sealed between the inner card 200 and the back panel 120. One method of sealing together the inner card 200 and back panel 120 is to have a heat seal coating on the inner or facing surfaces of one or both of the inner card 200 and back panel 120.

Figure 4:
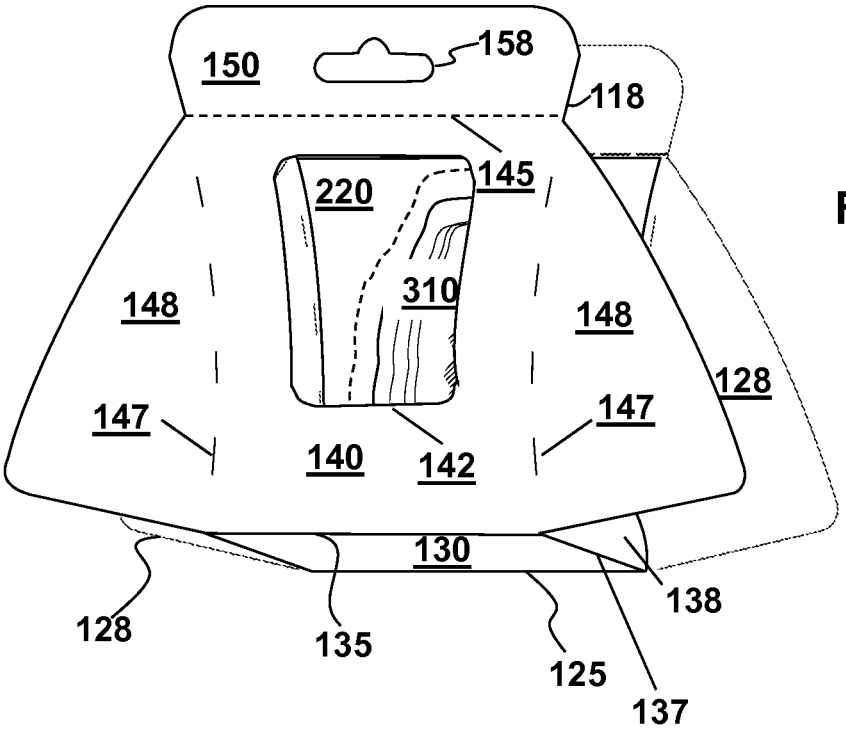
FIG. 4 is a perspective view of the outer housing having been partly folded around the inner card and blister.

As a further step in assembling the package, blank 100 may be folded into a housing or container around blister 300 and its contents. A step in the folding process is shown in FIG. 4, where the bottom panel 130 has been folded upward relative to back panel 120 (along fold line 125) and the front panel 140 folded upward relative to bottom panel 130 (along fold line 135). Also as shown in FIG. 4, bottom side panels 138 may be folded upward along fold lines 137.

Figure 5:
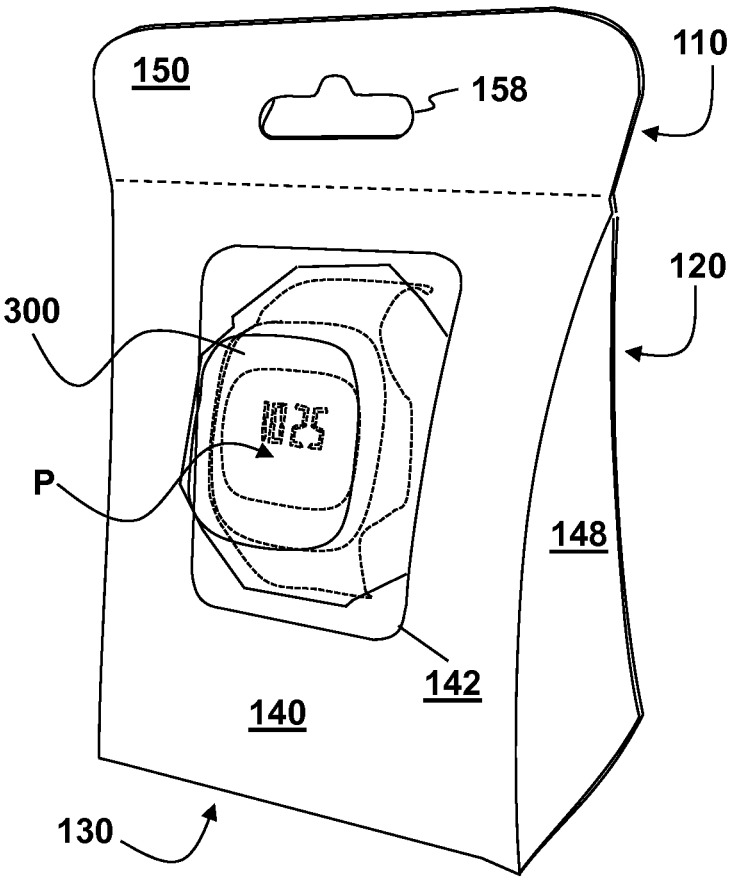
FIG. 5 is a perspective view of the finished package.

Finally, as shown in FIG. 5, back side flaps 128 may be folded forward along fold lines 127, and front side flaps 148 folded backward along fold lines 147 (thus overlapping the back side panels, or vice versa). The front side flaps 148 may be fastened or sealed to the back side flaps 128 for example by adhesive. Side panels are thereby formed which each include at least two plies of material, that is, a back side flap 128 and a front side flap 148 which overlap at least partly.

Front top flap 150 may be brought into facing contact with the back top flap 110, and fastened thereto, for example by adhesive or staples. The blister 300 and the product item P contained therein (for example, a watch) may be visible behind, or protrude through, window 142. Hang holes 118, 158 may overlap and provide a opening for hanging on a display hook.

Although the blister 300 construction shown here encloses a product, it is also contemplated that portions of the blister may be left open, for example to allow a customer to handle the product such as feeling the texture, observing the product directly (without looking through the blister material), testing a fit (e.g. for an electrical connection), and for other purposes.

Although the package shown here includes a blister, it should be understood that some products may be packaged without a blister, for example if the structure of the product allows it to be held by the inner card without the aid of a blister.

Although the package shown here includes an inner card, it should be understood that some products may be packaged without an inner card, for example if the blister (or the product itself) may be attached directly to the back panel 120.

The blanks 100, 200 may be formed of a sheet material such as paperboard, which may be made of or coated with materials to increase its strength. An example of such a sheet material is EASYSEAL paperboard made by MeadWestvaco Corporation. The sheet material may have a heat sealable coating, for example to allow a heat seal to be created between the various panels. Alternately, other forms of adhesive may be used to seal these parts together. It should be noted that the use of tear resistant materials, and/or in more than one layer, help to improve the tamper- and theft-resistance of the package. The panels may be joined together by heat sealing, RF (radio frequency) sealing, ultrasonic sealing, adhesive, or other means.

Blister 300 may be made with common thermoform plastics such as PVC, PET, or APET but may also include a recycled material such as RPET or a biodegradable material such as PLA. However other materials including other plastics (or paperboard, at least for the backing sheet) may also be used. Besides thermoforming, the blister may be formed by injection molding or other manufacturing methods. The blister may be formed in one or more pieces. For example the blister 300 may be formed from 0.015" thick PET plastic.

It should be understood that additional panels or fold-over panels may be included in the package for further reinforcing the package, providing additional advertising space, and so on.

The invention claimed is:

1. A package comprising:

a card having a front and a back surface, the card having an aperture therein;

a blister having a body portion and a peripheral flange, the body portion protruding forward through the aperture, the peripheral flange in facing contact with the back surface of the card; and a housing comprising a back panel having a top edge and an opposing bottom edge;

a front panel having a top edge and an opposing bottom edge, the front panel having a window therein; and a bottom panel between the bottom edges of the back panel and front panel;

wherein the card is attached to the back panel with the flange between the card and the back panel, the top edges of the back panel and front panel are attached together; and the blister body extends forward toward or through the window; and wherein the front surface of the card is not in facing contact with either of the front panel and back panel.

2. The package of claim 1, wherein the card comprises paperboard.

3. The package of claim 1, wherein the housing comprises paperboard.

4. The package of claim 1, wherein the top edges of the back panel and front panel are attached together by adhering together a back top flap extending from the back panel top edge and a front top flap extending from the front panel top edge.

5. The package of claim 1, further comprising a pair of side panels.

6. The package of claim 1, wherein each of the side panels comprises a first ply of material extending from the back panel and a second ply of material extending from the front panel.

7. The package of claim 1, wherein the bottom panel is not parallel with either of the back panel and the front panel.

8. The package of claim 1, wherein the package has a triangular form as viewed from the side.

9. The package of claim 5, wherein the front panel, bottom panel, back panel, and pair of side panels together enclose a wedge-shaped interior volume.

10. A package comprising:

a card having a front and a back surface, the card having an aperture therein;

a blister having a body portion and a peripheral flange, the body portion protruding forward through the aperture, the peripheral flange in facing contact with the back surface of the card; and a housing comprising a back panel having a top edge and an opposing bottom edge;

a front panel having a top edge and an opposing bottom edge, the front panel having a window therein; and a bottom panel extending between the bottom edges of the back panel and front panel, the bottom panel not parallel to either of the back panel and the front panel;

wherein the card is attached to the back panel with the flange between the card and the back panel, the top edges of the back panel and front panel are attached together; and the blister body extends forward toward or through the window.

11. A package comprising:

a card having a front and a back surface, the card having an aperture therein;

a blister having a body portion and a peripheral flange, the body portion protruding forward through the aperture, the peripheral flange in facing contact with the back surface of the card; and a housing comprising a back panel having a top edge and an opposing bottom edge;

a front panel having a top edge and an opposing bottom edge, the front panel having a window therein; and a bottom panel extending between the bottom edges of the back panel and front panel, the back panel, front panel, and bottom panel together bounding a wedge-shaped volume;

wherein the card is attached to the back panel with the flange between the card and the back panel, the top edges of the back panel and front panel are attached together; and the blister body extends forward toward or through the window.

* * * * *